US008011637B2

(12) United States Patent
Trimmer

(10) Patent No.: US 8,011,637 B2
(45) Date of Patent: Sep. 6, 2011

(54) CONCRETE FORM SYSTEM FOR LOW-CLEARANCE APPLICATIONS

(75) Inventor: Douglas E. Trimmer, Oak Grove, MO (US)

(73) Assignee: Precise Forms, Inc., Bates City, MO (US)

( * ) Notice: Subject to any disclaimer, the term of this patent is extended or adjusted under 35 U.S.C. 154(b) by 886 days.

(21) Appl. No.: 11/763,866

(22) Filed: Jun. 15, 2007

(65) Prior Publication Data

US 2008/0307736 A1 Dec. 18, 2008

(51) Int. Cl.
*E04G 11/08* (2006.01)
*E04G 17/065* (2006.01)

(52) U.S. Cl. ..... 249/45; 249/43; 249/191

(58) Field of Classification Search ..... 249/40, 249/43, 44, 45, 47, 190, 191, 192, 213, 216; 220/4.33; 312/140, 263, 265.5; 52/584.1
See application file for complete search history.

(56) References Cited

U.S. PATENT DOCUMENTS

| | | | | | |
|---|---|---|---|---|---|
| 839,819 | A | * | 1/1907 | Horse | 249/40 |
| 1,270,793 | A | * | 7/1918 | Davidson | 249/36 |
| 1,401,898 | A | * | 12/1921 | Farness | 249/36 |
| 1,482,434 | A | * | 2/1924 | Hotchkiss | 249/192 |
| 1,588,229 | A | * | 6/1926 | Hotchkiss | 249/45 |
| 1,743,136 | A | * | 1/1930 | Harrold | 249/192 |
| 1,779,908 | A | * | 10/1930 | Graziano | 249/43 |
| 2,373,808 | A | * | 4/1945 | Brown | 52/471 |
| 2,511,584 | A | * | 6/1950 | Hill | 249/27 |
| 2,523,131 | A | * | 9/1950 | Martin | 249/42 |
| 2,763,911 | A | * | 9/1956 | Rumble | 249/45 |
| 2,963,763 | A | * | 12/1960 | Le Cluyse | 249/190 |
| 3,661,354 | A | * | 5/1972 | Dagiel et al. | 249/192 |
| 3,899,155 | A | * | 8/1975 | Ward | 249/189 |
| 3,977,647 | A | * | 8/1976 | Williams | 249/191 |
| 4,159,097 | A | * | 6/1979 | Strickland | 249/40 |
| 5,251,861 | A | | 10/1993 | Hayashi | |
| RE34,892 | E | * | 4/1995 | Dunwoodie | 220/1.5 |
| 5,761,874 | A | * | 6/1998 | Hayakawa | 52/701 |
| 5,799,399 | A | * | 9/1998 | Schultz | 29/897.3 |
| 5,833,873 | A | * | 11/1998 | Adonetti | 249/47 |
| 5,836,126 | A | * | 11/1998 | Harkenrider et al. | 52/410 |
| 5,855,807 | A | * | 1/1999 | Hsieh | 249/43 |

(Continued)

*Primary Examiner* — Michael Safavi
*Assistant Examiner* — Joshua Rodden
(74) *Attorney, Agent, or Firm* — Hovey Williams LLP

(57) ABSTRACT

Improved concrete form systems (10) are provided which permit erection of the systems (10) in close quarters adjacent existing structures, e.g., the systems (10) may be successfully installed with as little as 2-½ inches of clearance between such existing structures. The systems (10) include spaced apart outer and inner wall sections (12, 14) each formed of juxtaposed, interconnected form panels (16, 18, 20, 22), with connection assemblies (24, 25) serving to interconnect the adjacent form panels (16, 18, 20, 22) of each wall section (12, 14), and to cross-connect the wall sections (12, 14). Each form panel has a planar panel segment (26) having side marginal connection structures (48) preferably including concave surfaces (50, 52). The connection assemblies (24, 25) have elongated connection elements (58, 82) having central openings (60*a*) and laterally extending legs (62, 64) which mate with the surfaces (50, 52) A series of elongated, threaded connector bodies (72) extend through the element openings (60*a*) and are threadably secured via threaded ferrules (70) forming a part of the elements (58), and nuts (84) forming a part of elements (82). The threaded connection of the bodies (72) serves to draw together the adjacent form panels (16, 18, 20, 22) by virtue of a camming action between the legs (62, 64) and the surfaces (50, 52). Such threaded connections also cross-connect the wall sections (12, 14).

7 Claims, 5 Drawing Sheets

U.S. PATENT DOCUMENTS

| | | | | |
|---|---|---|---|---|
| 5,965,053 | A * | 10/1999 | Carlson | 249/191 |
| 6,024,339 | A * | 2/2000 | Gates | 249/45 |
| 6,601,820 | B2 * | 8/2003 | Gates | 249/191 |
| 6,935,607 | B2 * | 8/2005 | Ward et al. | 249/190 |
| 7,152,843 | B2 * | 12/2006 | Ward et al. | 249/216 |
| 7,182,308 | B2 | 2/2007 | Trimmer et al. | |
| 2004/0079860 | A1 * | 4/2004 | Ward et al. | 249/33 |
| 2004/0200168 | A1 * | 10/2004 | Takagi et al. | 52/415 |
| 2008/0017783 | A1 * | 1/2008 | Vanagan | 249/192 |

* cited by examiner

CONCRETE FORM SYSTEM FOR LOW-CLEARANCE APPLICATIONS

BACKGROUND OF THE INVENTION

1. Field of the Invention

The present invention is broadly concerned with improved concrete form assemblies which can be readily erected in close quarters with adjacent, preexisting structures. More particularly, the invention is concerned with such form assemblies and the components thereof, which allow form erection and disassembly with as little as ½ inch clearance between the form and an adjacent building or the like.

2. Description of the Prior Art

Many present day poured concrete structures are constructed using prefabricated, reusable, interlocking form sections or panels. These panels are necessarily of relatively high strength, yet preferably are compact and lightweight. Thus, concrete form panels are advantageously constructed from aluminum, and are designed to be interconnected end-to-end as well as in opposed relationship, to present a wall form for example. For purposes of end-to-end interconnection, the panels generally include vertically extending end walls having a series of spaced openings therethrough. When placed in juxtaposition with the end wall apertures in alignment, the individual panels are typically interconnected by means of slotted pin and wedge assemblies. Thus, slotted pins are driven through aligned end wall apertures, and a wedge is then placed within the pin slot in order to lock the individual panels together. When the form is disassembled, the wedges are loosened and removed, and the pins extracted from the form panel apertures. Other types of form panel connection apparatus have been proposed, wherein the connectors are wholly or largely permanently affixed to the panels. See, e.g., U.S. Pat. Nos. 5,251,861 and 7,182,308.

Cross-connection of concrete form panels is often accomplished using what is referred to as "taper-tie" connectors. In such situations, a series of elongated connecting rods extend between opposed form panels and are secured at their outer ends by means of threaded fasteners. The inner portion of the connecting rods between the opposed form panels is covered with a tubular conical sleeve to permit extraction of the connection rods after a concrete wall is formed. These connecting rods are typically located at the central region of the form panels, rather than at the side margins thereof. This is because it is difficult to attach the connecting rod fasteners at the side margins, where the later form connection hardware is located. However, such central taper-tie assemblies can be difficult to install, and do not give maximum support at the critical joints between the form panels.

These existing concrete form assemblies require workmen access along the exterior surfaces of the separate form walls as they are erected. This in turn necessitates that a minimum clearance of several feet is required from existing structures and the like, in order to allow such access. In some instances, however, this degree of clearance is simply not available, making the form erection process very difficult if not impossible.

Other existing wall form assemblies for use in low-clearance situations are provided as unitary, elongated form structures, as opposed to a plurality of individual panels secured together. Such elongated wall sections may be set in place without need for workmen access along the exterior surfaces of the form. However, these wall sections are generally very heavy and require the use of a mechanical hoist (such as a crane) in order to be set in place.

There is accordingly a need in the art for improved concrete form assemblies which can be successfully hand-erected in very low clearance situations, while nonetheless providing stable and commercially reasonable complete forms.

SUMMARY OF THE INVENTION

The present invention overcomes the problems outlined above and provides low-clearance concrete form assemblies of simplified design, and which can be hand-constructed with worker access only along one side of the assemblies. Broadly speaking, the form assemblies of the invention comprise a first wall section including at least first and second juxtaposed form panels each having an inner surface, an outer surface, opposed top and bottom margins, and a pair of opposed side marginal connection structures extending between the top and bottom margins. The first and second form panels are in juxtaposed relationship with the side marginal connection structure of the first panel being proximal to the side marginal connection structure of the second panel. An elongated first connector element is positioned in bridging relationship to and engaging the side marginal connection structures of the first and second panels, with the first connector element presenting a series of openings along the length thereof.

The overall form assemblies further comprise a second wall section including third and fourth juxtaposed form panels each having an inner surface, an outer surface, opposed top and bottom margins, and a pair of opposed side marginal connection structures extending between the top and bottom margins. The third and fourth form panels are in juxtaposed relationship with the side marginal connection structure of the third panel being proximal to the side marginal connection structure of the fourth panel. An elongated second connector element is located in bridging relationship to and engaging the side marginal connection structures of the third and fourth panels, with the second connector presenting a plurality of openings along the length thereof.

In the form assemblies, the first and second connector element openings are in general alignment, and a plurality of connector bodies extend between the first and second wall sections. Each of the connector bodies have threaded ends respectively extending into the first and second connector element openings. Threaded couplers are operably threaded to the threaded ends of the connector bodies.

The first and second panels are drawn together by virtue of the inter-engagement of the side marginal connection structures thereof and the first connector element, and the threaded connection between the adjacent ends of the connector bodies and the threaded couplers. Likewise, the third and fourth panels drawn to-ether because of the inter-engagement of the side marginal connection structures thereof and the second connector element, and the threaded connection between the adjacent ends of the connector bodies and the threaded couplers. In this fashion, the form panels making up the opposed first and second wall sections are firmly interconnected, and at the same time the opposed wall sections are securely cross-connected.

In preferred forms, the side marginal connection structures of the form panels and the associated connector elements have cooperating, inter-engaged cam surfaces, so that tightening of the connector bodies draws the form panels together while also cross-connecting the opposed wall sections. Such cam surfaces are advantageously of mating, concavo-convex configuration.

The individual concrete form panels of the invention comprise generally planar panel segments with side marginal connection structures, preferably including interconnected oblique and arcuate surfaces cooperatively presenting concave cam surfaces. In addition, the panel connection structures have outermost butt edges including a series of recesses formed therein. When a pair of form panels are placed in juxtaposition, the recesses cooperatively define through-openings which receive the threaded connector bodies. In this way the connector bodies extend through openings along the joint or juncture between the form panels, for maximum strength in the resultant forms.

DETAILED DESCRIPTION OF THE PREFERRED EMBODIMENT

Figure 1:
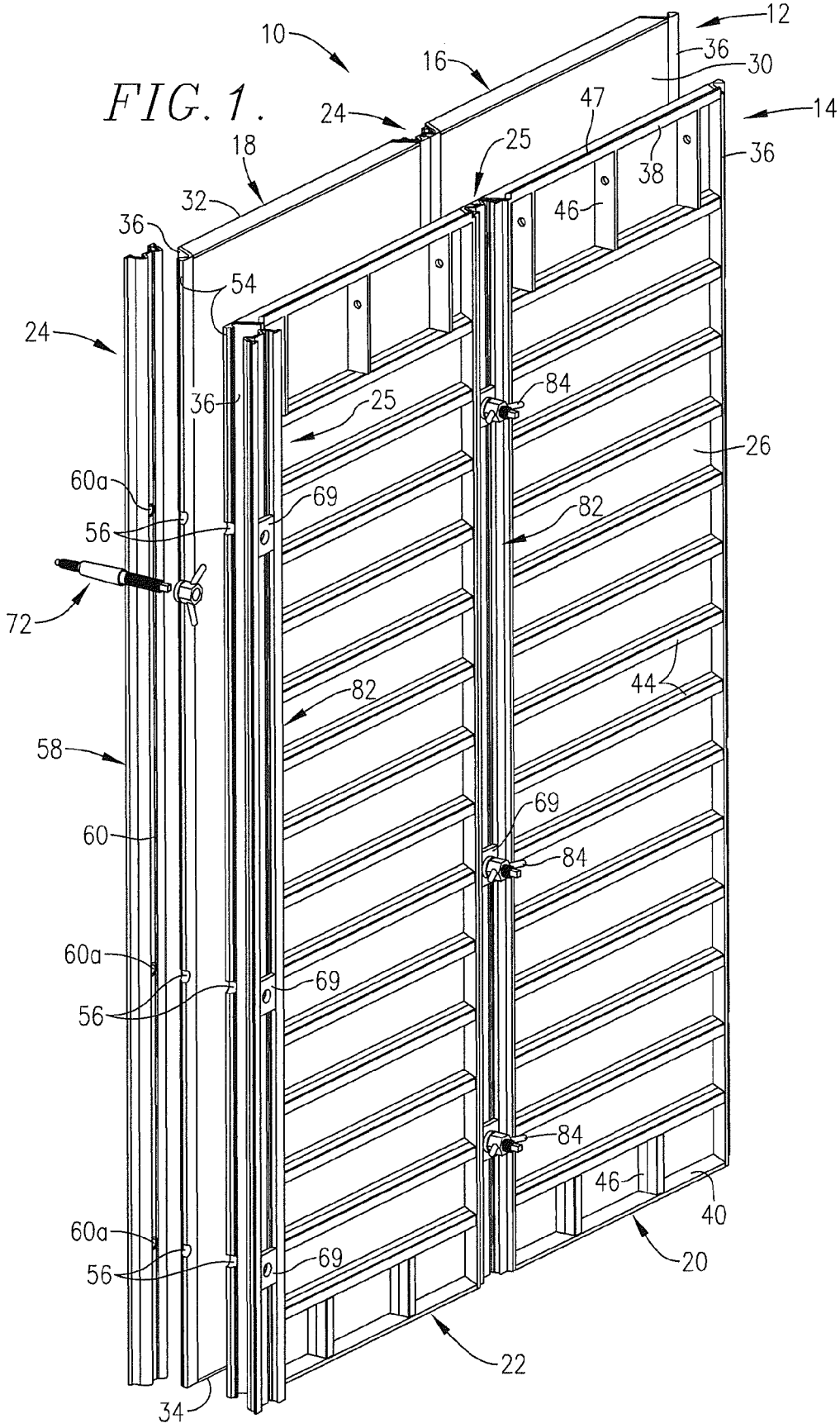
FIG. 1 is an exploded perspective view illustrating a pair of opposed concrete form wall sections each made up of a pair of juxtaposed form panels, and further illustrating the preferred connection structure for the wall sections.
Figure 2:
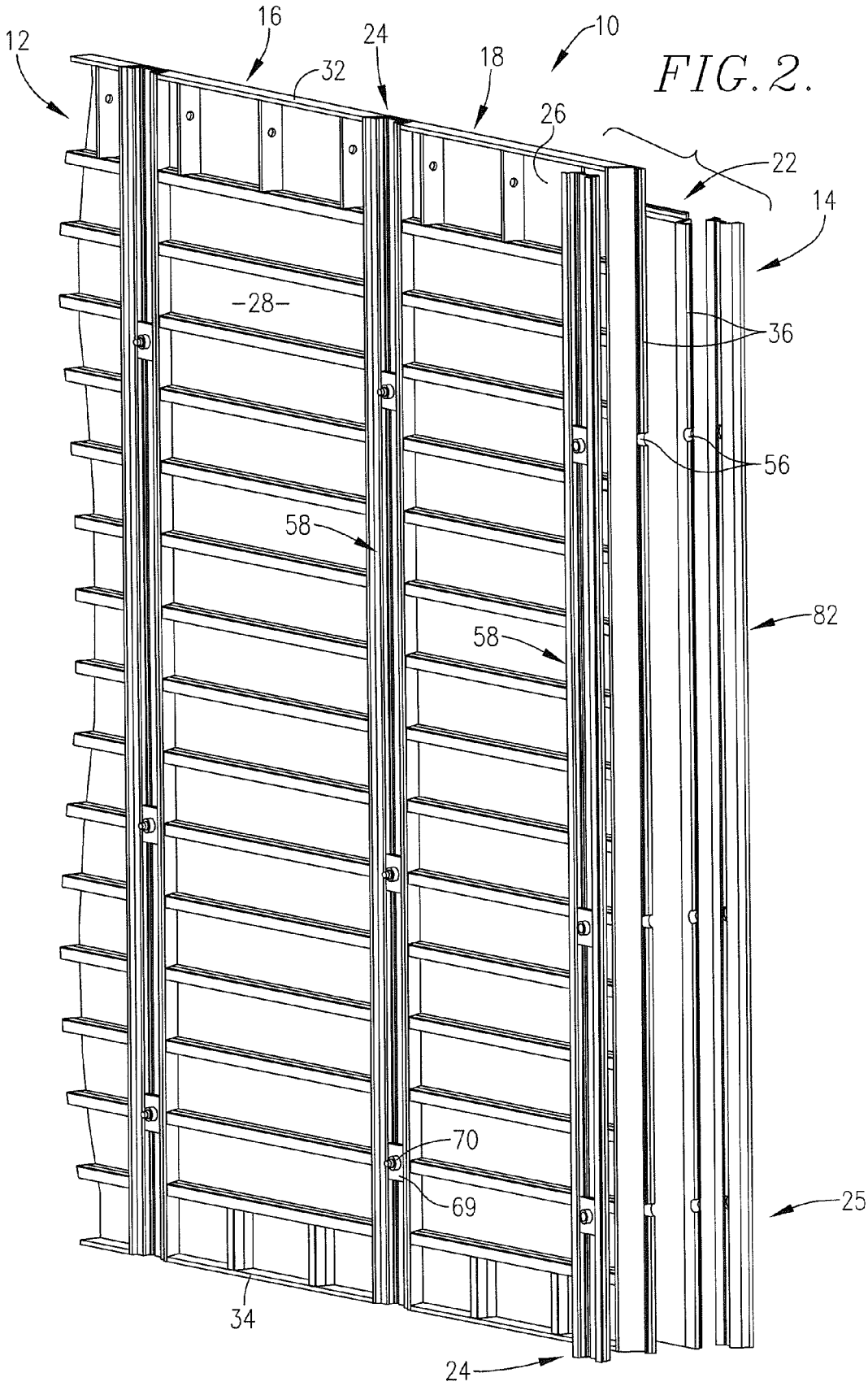
FIG. 2 is a view similar to that of FIG. 1, but illustrating the concrete form wall sections from the opposite side as compared with FIG. 1.

Turning now to FIGS. 1 and 2, a segment 10 of a concrete form is illustrated with the components thereof in exploded relation. Broadly speaking, the form segment 10 includes a first, outer wall section 12 and an opposed, second, inner wall section 14. The outer wall section 12 includes a pair of juxtaposed first and second concrete form panels 16 and 18, and similarly inner wall section 14 includes a pair of juxtaposed third and fourth concrete form panels 20 and 22. Connection assemblies 24 and 25 are used to interconnect the first and second form panels 16, 18 and the third and fourth form panels 20, 22, respectively. The connection assemblies 24 also cross-connect the outer and inner wall sections 12, 14 as will be explained.

Each of the form panels 16, 18, 20, 22 are substantially identical (i.e., the form panels 16 and 18 making up outer wall section 12 are identical with each other, and the form panels 20, 22 making up the inner wall section 14 are identical with each other, but are slightly different than the outer wall section form panels 16, 18, as will be described). For example, the outer wall panels 16 and 18 are slightly higher than the corresponding inner wall panels 20, 22 so as to permit formation of horizontal decking. The panels 16, 18, 20, 22 include a generally planar panel segment 26 presenting an outer surface 28, and opposed inner surface 30, a top margin 32, a bottom margin 34, and a pair of specially configured sidewalls 36 extending between the top and bottom margins 32, 34. The outer surface 28 of each form panel also has outwardly extending, top and bottom walls 38, 40 connected with sidewalls 36, as well as horizontally and vertically extending reinforcing ribs 44, 46. The inner wall panels 20, 22 also have an upstanding lip 47 along the upper margins 32 as best seen in FIG. 1.

Figure 4B:
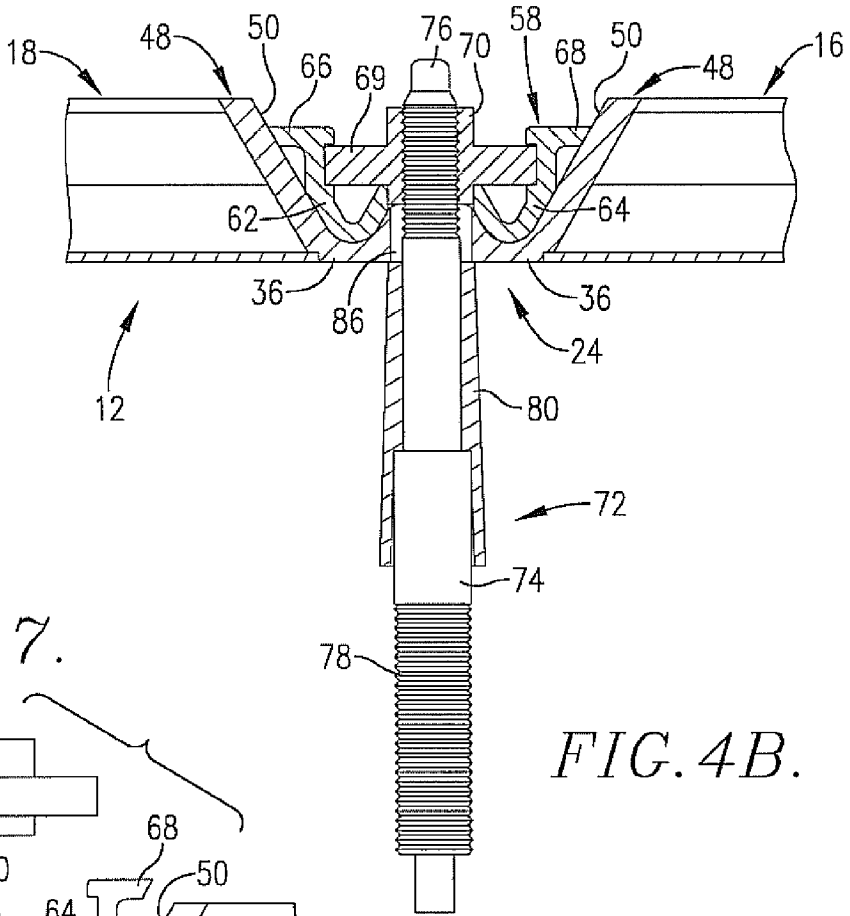
FIG. 4B is a fragmentary sectional view similar to that of FIG. 4A, and showing the next step in the installation of the threaded connection assemblies of the invention.
Figure 4A:
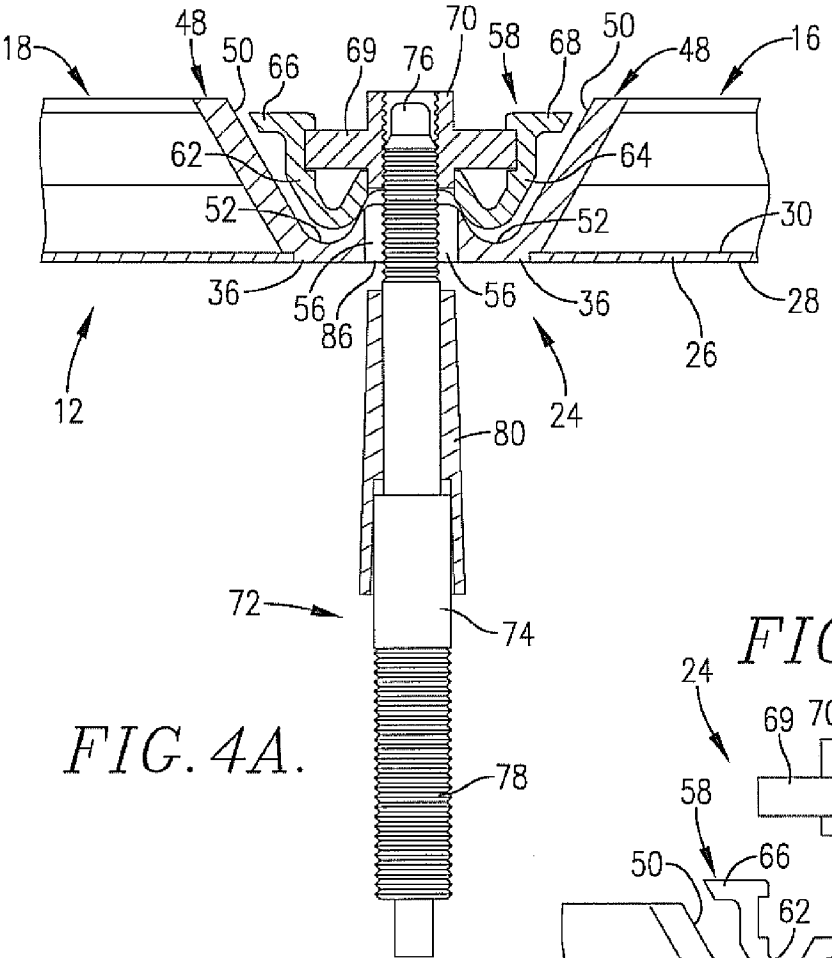
FIG. 4A is a fragmentary sectional view illustrating the first step in attachment of one of the threaded connection assemblies of the invention.

The sidewalls 36 of each form panel provide integral connection structure 48 (see FIG. 4A) forming a part of the connection assemblies 24. This connection structure includes an end wall presenting an obliquely oriented surface 50, as well as an arcuate surface 52 extending from the surface 50. The surfaces 50, 52 cooperatively define a concavo-convex surface arrangement which is important for purposes to be described. In addition, the structure 48 has an outermost butt edge 54 provided with a series of vertically spaced apart, substantially semi-circular recesses 56 along the length thereof.

Figure 7:
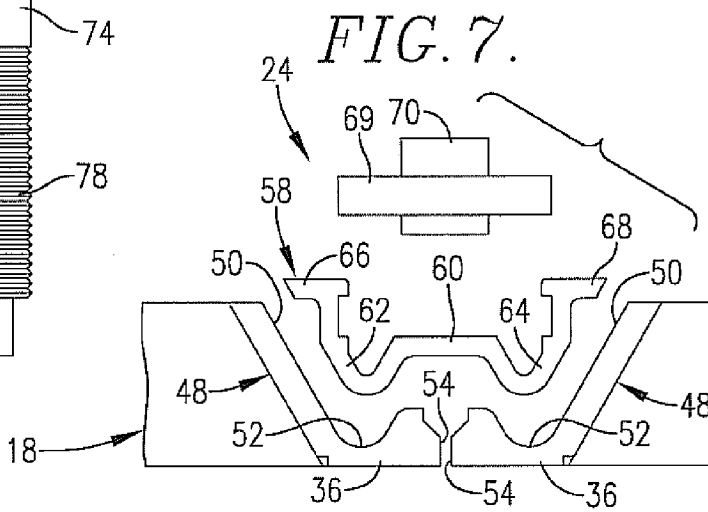
FIG. 7 is a fragmentary, exploded top view illustrating components forming the connection between adjacent form panels.
Figure 6:
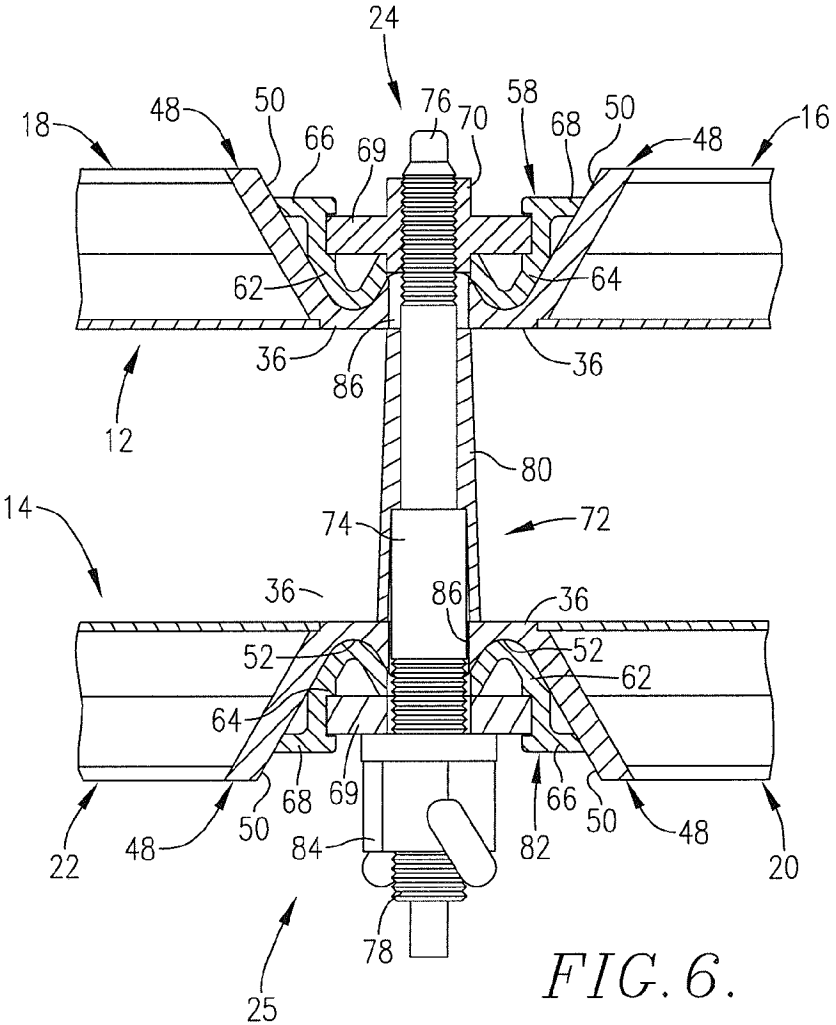
FIG. 6 is a fragmentary sectional view similar to that of FIG. 5, and illustrating the final step in securing the connection assembly.
Figure 5:
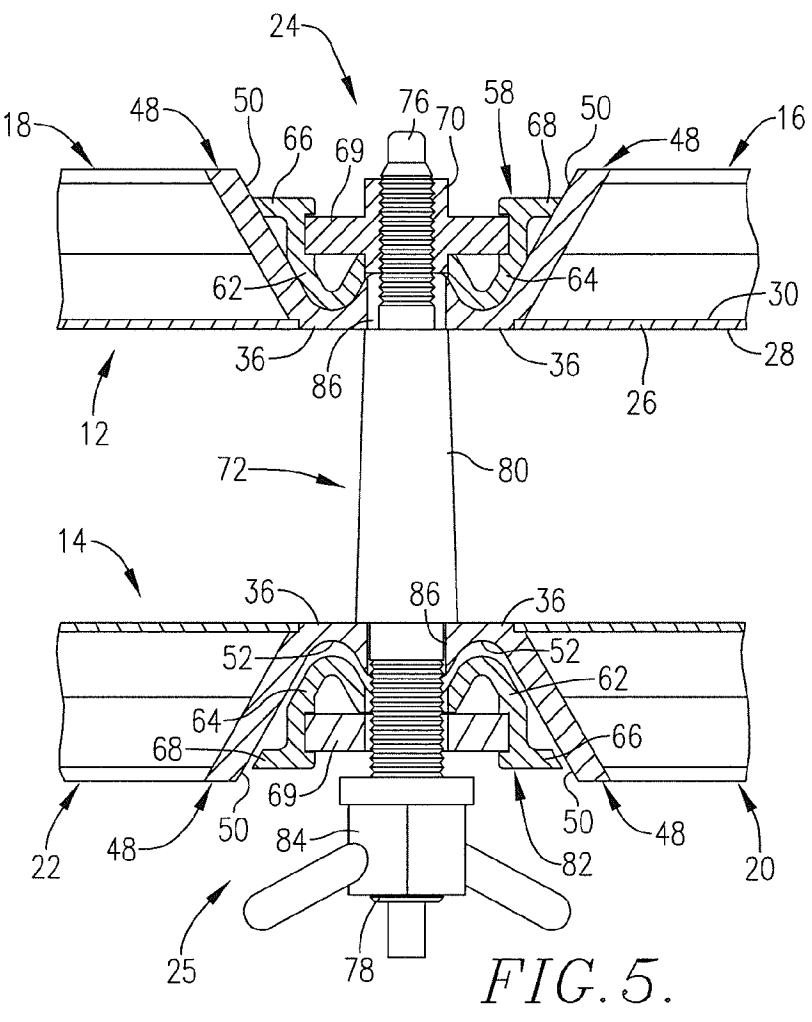
FIG. 5 is a fragmentary sectional view illustrating the erection of an opposed concrete form wall section using the threaded connectors, and depicts the first step in securing the opposed wall section using one of the threaded connection assemblies.

The connection assemblies 24 (see FIG. 7) include an elongated connection element 58 of somewhat W-shape cross-section and having a central web 60 as well as laterally outwardly extending, arcuate, concavo-convex legs 62 and 64 with outermost flanges 66, 68. The web 60 has a series of openings 60*a* along the length thereof, as well as corresponding apertured reinforcement plates 69 in registry with openings 60*a* and welded to the legs 62, 64 as shown. The plates 69 are provided with outwardly extending threaded ferrules 70 likewise in register with the openings 60*a* and the plate apertures. The assemblies 24 also have a series of elongated connector bodies 72 in the form of a stepped diameter rod 74 having an outer threaded end 76 and an opposed, larger diameter inner threaded end 78. As best seen in FIG. 3-6 a conical sleeve 80 is telescoped over the central section of rod 74.

The connection assemblies 25 are very similar to the assembles 24, and include elongated connector elements 82 (see FIGS. 5 and 6) which are identical with elements 58 (and are accordingly identically numbered), except that the plates 69 have larger apertures therethrough to accommodate the larger diameter ends of the connector bodies 72, and do not have the threaded ferrules 70. Additionally, the assemblies 25 include wing nuts 84 sized to be threaded onto the ends 78 of the bodies 72. The overall assemblies 25 also include the connector bodies 72, i.e., the bodies 72 are a part of both the assemblies 24 and 25.

The erection of form segment 10 broadly involves first erecting the outer wall section 12 with projecting connector bodies 72, and thereupon erecting inner wall section 14. In particular, in the first step the first and second panels 16 and 18 are placed in side-by-side adjacency with the butt edges 54 in close proximity to define a vertical joint 73. A connector element 58 is then placed between the panels so as to engage the connection structures 48 of the panels 16, 18. That is, the arcuate legs 62, 64 of the elements 58 are situated in partial nesting relationship to the connection structures 48 of the proximal panels 16, 18 (See FIG. 4A). In this orientation, the butt edge recesses 56 of the panels cooperatively define substantially circular through-openings 86 along joint 73 and substantially in alignment with the openings 60*a* and the openings of the plates 69 of the connector elements 58.

Figure 3:
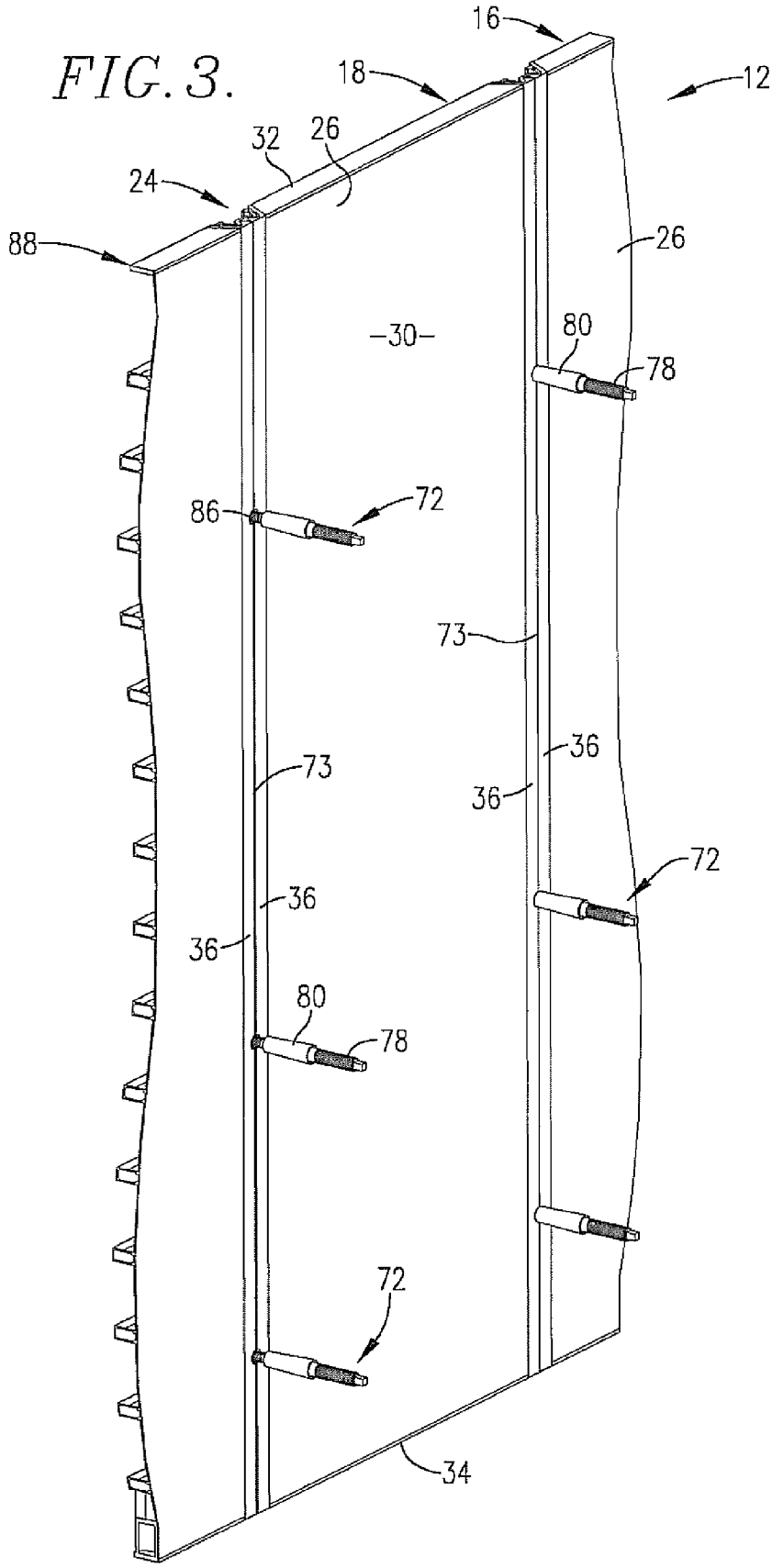
FIG. 3 is a fragmentary perspective view illustrating three form panels in side-by-side relationship, and with threaded connectors in accordance with the invention interconnecting the three form panels.

Next, the small diameter threaded ends 76 of the connector bodies 72 are inserted through the through-openings 86 and plates 69, and are threaded into the ferrules 70. The bodies 72 may be threaded completely so that the small diameter ends of sleeves 80 abut the panels (see FIG. 4B) or may be left loose (see FIG. 4A). Complete threading of the bodies 72 into the ferrules 70 serves to draw the panels 16, 18 firmly together through a cam action between the arcuate legs 62, 64, and the adjacent, inter-engaged surfaces 50, 52 of the connection structures 48. This connected condition is illustrated in FIG. 3, wherein the connector bodies 72 extend outwardly from the first outer wall section 12; FIG. 3 also depicts a third panel 88 being connected to panel 18.

In order to complete the form segment, the third and fourth panels 20, 22 are erected about the large diameter ends of the projecting connector bodies 72. Specifically, the panels 20, 22 are located in adjacency with the butt edges 54 thereof in close proximity, and with the butt edge recesses 56 defining the through openings 86 receiving the connector bodies 72. The elongated connector elements 82 are then installed by passing the connector bodies 72 through the plate apertures, and with the arcuate legs 62 thereof in partial nesting relationship with the panel connection structures 48 (See FIG. 5). The wing nuts 84 are then threaded onto the large diameter ends 78 of the connector bodies 72, and are drawn tight against the plates 69 (See FIG. 6). In the event that the small diameter ends are only loosely threaded into the ferrules 70, these are fully threaded before application of the wing nuts 84. Again, full, tightened threading of the nuts 84 draws the form panels 20, 22 together because of the camming engagement between the surfaces of the legs 62, 64 of the connector elements 82, and the surfaces 50, 52 of the panel connection structures 48. In the final orientation of the first and second wall sections, it will be seen that the sleeves 80 of the connector bodies 72 span the distance between the inner surfaces of the form panels and abut each of the latter.

While wall sections 12 and 14 have been shown only using a pair of side-by-side panels in each case, it will be appreciated that most forms will use a large number of panels. Such additional panels are interconnected panel-by-panel in the manner described, to obtain the desired form length and configuration. In addition, a wide variety of mating wall configurations can be used in the connection structures 48 of the form panels and the associated connector elements 58 and 82. Thus, the depicted mating concavo-convex wall configurations are only exemplary embodiments.

Once completed, the forms of the invention are used in the conventional fashion, i.e., concrete is poured between the form wall sections and allowed to harden to form a concrete wall (not shown). Thereafter, the forms are disassembled from the concrete wall for reuse. This involves detaching the wing nuts 84 from the connector bodies 72, followed by the removal of the connector elements 82 and form panels 20, 22. At this point, the connector bodies are unthreaded from the ferrules 70 and pulled from the concrete wall. This permits removal of the connector elements 58 and form panels 16, 18 by pulling these items directly upwardly. Finally, the passageways left by the connector elements 72 are filled with grout.

A principal advantage of the concrete forms of the invention is the ability to erect and disassemble the forms in close quarters and with small clearances between pre-existing structures. Indeed, the forms of the invention can be erected and disassembled with as little as 2-½ inches of clearance between such pre-existing structures. In this regard, the special design of the form panels and connection structures allows erection of outer wall section 12 without the need of workman positioned outboard of the outer wall form panels.

Although the invention has been described with reference to the presently preferred embodiment, it will be appreciated that a variety of changes can be made in this embodiment without departing from the spirit and scope of the invention. For example, conventional taper-tie cross-connectors can be used in lieu of the more specialized and preferred connector bodies 72. Further Also, the configuration of the respective camming surfaces in the connection assemblies 24 can be selected from a wide variety of such configurations, so long as the ends of the invention are met.

It is also understood that in certain embodiments, the form assemblies need only comprise one wall section 12 constructed in accordance with the present invention. Wall section 14 may be replaced with a conventional wall section known to those of skill in the art. In such embodiments, conventional tie systems like the taper-ties discussed above may also be employed. Thus, wall section 12, which is to be assembled adjacent the existing structure or in the low-clearance area, exhibits surprising versatility in that it may be used in conjunction with other types of wall form sections.

I claim:

1. A concrete form assembly comprising:

a first wall section including first and second juxtaposed form panels each having an inner surface, an outer surface, opposed top and bottom margins, and a pair of opposed side marginal connection structures extending between said top and bottom margins, said first and second form panels being in juxtaposed relationship with a side marginal connection structure of the first panel being proximal to the side marginal connection structure of the second panel;

an elongated first connector element in bridging relationship to and engaging the side marginal connection structures of the first and second panels, said first connector presenting a plurality of openings along the length thereof;

a second wall section including third and fourth juxtaposed form panels each having an inner surface, an outer surface, opposed top and bottom margins, and a pair of opposed side marginal connection structures extending between said top and bottom margins, said third and fourth form panels being in juxtaposed relationship with a side marginal connection structure of the third panel being proximal to the side marginal connection structure of the fourth panel;

an elongated second connector element in bridging relationship to and engaging the side marginal connection structures of the third and fourth panels, said second connector presenting a plurality of openings along the length thereof, said first and second connector element openings being in general alignment;

a plurality of connector bodies extending between said first and second wall sections and each having a threaded end extending into one of said first connector element openings, and an opposed threaded end extending into one of said second connector element openings; and threaded couplers operably threaded to the threaded ends of said connector bodies, at least one of said threaded couplers engaging said first connector element and at least one other of said threaded couplers engaging said second connector element, said first and second panels drawn toward each other through a cam action between said first connector element and said first and second panel side marginal connection structures, said cam action resulting from the threading of said threaded ends of said connector bodies into said threaded couplers engaging said first connector element, said third and fourth panels drawn toward each other through a cam action between said second connector element and said third and fourth panel side marginal connection structures, said cam action resulting from the threading of said opposed threaded ends of said connector bodies into said threaded couplers engaging said second connector element.

2. The form assembly of claim 1 said first connector element and said side marginal connection structures of the first and second panels having cooperating cam surfaces in engagement with each other.

3. The form assembly of claim 2, said cam surfaces of said first connector element being of concavo-convex configuration, and said cam surfaces of said side marginal connection structures of said first and second panels being of concave configuration which mate with the concavo-convex cam surfaces of said first connector element.

4. The form assembly of claim 1, said second connector element and said side marginal connection structures of the third and fourth panels having cooperating cam surfaces in engagement with each other.

5. The form assembly of claim 4, said cam surfaces of said second connector element being of concavo-convex configuration, and said cam surfaces of said side marginal connection structures of said third and fourth panels being of concave configuration which mate with the concavo-convex cam surfaces of said second connector element.

6. The form assembly of claim 1 said first connector element having a series of said threaded couplers engaging said first connector element in the form of threaded nuts secured to and in registry with said openings in the first connector element, said nuts each being operable to threadably receive the one end of said connectors bodies.

7. The form assembly of claim 1, said second connector element having a series of said threaded couplers engaging said second connector element in the form of threaded nuts separate from said second connector element and each being operable to threadably receive the one end of said connectors bodies.

* * * * *